United States Patent [19]

Burgess et al.

[11] 4,360,259

[45] Nov. 23, 1982

[54] DIAZO DEVELOPING APPARATUS

[76] Inventors: Dennis A. Burgess, 14980-18th Ave. No., Plymouth, Minn. 55441; Kenneth D. Rebers, 9016-31st Ave. No., New Hope, Minn. 55427

[21] Appl. No.: 234,203

[22] Filed: Feb. 13, 1981

[51] Int. Cl.[3] ..... G03D 7/00

[52] U.S. Cl. ..... 354/299; 354/300; 354/319; 34/242; 29/132

[58] Field of Search ..... 354/299, 300, 319, 320, 354/321, 322, 297; 34/155, 242; 29/129.5, 132

[56] References Cited

U.S. PATENT DOCUMENTS

| | | | |
|---|---|---|---|
| Re. 26,525 | 2/1969 | Wilde et al. . | |
| 2,172,783 | 9/1939 | Alink et al. . | |
| 2,515,144 | 7/1950 | Trump et al. . | |
| 2,918,069 | 12/1959 | Brown et al. | 354/319 |
| 3,012,492 | 12/1961 | Goodman et al. . | |
| 3,145,637 | 8/1964 | Frantz . | |
| 3,435,751 | 4/1969 | Goodman et al. . | |
| 3,496,332 | 2/1970 | Lunde | 354/299 |
| 3,534,673 | 10/1970 | Muller . | |
| 3,546,363 | 12/1970 | Bricher et al. . | |
| 3,688,082 | 8/1972 | Crane et al. . | |
| 3,724,047 | 4/1973 | Peterson | 29/132 |
| 3,971,115 | 7/1976 | Schneider et al. | 29/132 |
| 4,052,732 | 10/1977 | Meadows | 354/297 |
| 4,056,824 | 11/1977 | Iiyana et al. . | |
| 4,062,031 | 12/1977 | Schroter . | |
| 4,147,422 | 4/1979 | Kahle et al. . | |
| 4,148,575 | 4/1979 | Siryj | 354/300 |
| 4,150,992 | 4/1979 | Meadows et al. . | |
| 4,166,688 | 9/1979 | Sachs | 354/319 |
| 4,167,319 | 9/1979 | Feitzinger et al. | 354/300 |
| 4,181,420 | 1/1980 | Blume et al. . | |
| 4,187,023 | 2/1980 | Schausberger et al. | 354/321 |
| 4,199,249 | 4/1980 | Welp et al. . | |
| 4,255,037 | 3/1981 | Meadows et al. | 354/299 |
| 4,286,859 | 9/1981 | Kurek | 354/300 |

FOREIGN PATENT DOCUMENTS

| | | | |
|---|---|---|---|
| 654809 | 12/1937 | Fed. Rep. of Germany | 354/300 |

OTHER PUBLICATIONS

"Burgess Diazo and Thermal Film Developers", Burgess Industries.

*Primary Examiner*—L. T. Hix
*Assistant Examiner*—Alan Mathews
*Attorney, Agent, or Firm*—James V. Harmon

[57] ABSTRACT

A diazo developer is described which is useful for both ammonia vapor developing and for thermal developing. A heated chamber is provided with inlet and outlet slots through which the sheets pass during operation. Adjacent the inlet slot is a pair of inlet rollers that carry the sheets through the chamber. Adjacent the outlet slot is a pair of outlet rollers. At least some of the rollers are driven by a motor and one or more are preferably yieldably biased toward its mating roller, e.g. by the provision of a thin ribbon-shaped sealing strip engaged against the roller at a point opposite the nip or contact line between the rollers to yieldably bias them together while at the same time sealing the chamber against the leakage of vapor when used. Side plates are provided at the ends of the rollers and resilient gasket sheets formed from elastomeric material are compressed between the roll ends and the fixed side plates to seal the chamber. Heaters such as electrical resistance heaters are continuously supported along their length by the developing chamber wall. The rollers have metal interiors and elastomeric hose members engaged over the rollers elastically have precision ground surfaces that carry the sheets through the apparatus.

14 Claims, 12 Drawing Figures

DIAZO DEVELOPING APPARATUS

FIELD OF THE INVENTION

Present invention relates to sheet developing equipment and more particularly to an apparatus for developing diazo sheet material.

THE PRIOR ART

The skyrocketing cost of silver has made diazo printing much more attractive in recent years and, accordingly, the market for reliable equipment to develop diazo sheet material, that is to say both coated paper sheets and plastic film, has increased rapidly in the last few years. In many prior devices, the sheets being developed contact machine parts as they pass through the machine. This can scratch the film which is, of course, undesirable. Another problem has been even and reliable exposure of the diazo sheets to developing material such as ammonia vapor. A further problem has been the high cost and unsatisfactory precision of the rolls used for carrying the sheets through the apparatus. A further problem has been the leakage of ammonia vapor from the devloping chamber at the location of the seal between the inlet and outlet rolls and the developing chamber and the uniform conduction of heat to the developing chamber as well as the prevention of heaters from moving or being displaced during operation. For example, in some prior equipment electrical resistance heater rods are used which are inadequately supported and the rods sometimes move slightly or droop during operation. In addition, heat is not conducted uniformly to different parts of the chamber. This can cause uneven heating, which is, of course, undesirable.

OBJECTS

In view of these and other deficiencies of the prior art, this invention has as its major objective the provision of an improved diazo sheet developer with the following characteristics and advantages:

(a) Capacity for developing diazo sheets with either ammonia vapor or heat alone, (b) the provision of dual purpose members engaged against inlet and outlet rollers to provide a vapor seal and, at the same time, yieldably bias rollers into engagement with one another, (c) the provision of an ammonia development chamber composed of tanks having a C or channel-shaped cross-section with a reliable means for sealing their ends against the leakage of vapor, (d) the provision of a low-cost construction and production method for rollers to be used in a diazo sheet developer wherein the rollers are strong, resistant to deflection or bending, and have resilient cylindrical surfaces with precise dimensions, (e) a diazo sheet developer with a reliable provision for collecting and disposing of ammonia fumes that escape from the development chamber, (f) provision for preventing the vapors from escaping around the ends of the drive and idler rollers, (g) the provision of a fume removal device that effectively removes and disposes of any vapor escaping from either the pump or development chamber and, (h) provision for securely supporting and retaining the electrical heating rods while at the same time distributing heat provided by the rods uniformly throughout the apparatus.

THE FIGURES

SUMMARY OF THE INVENTION

Figure 1:
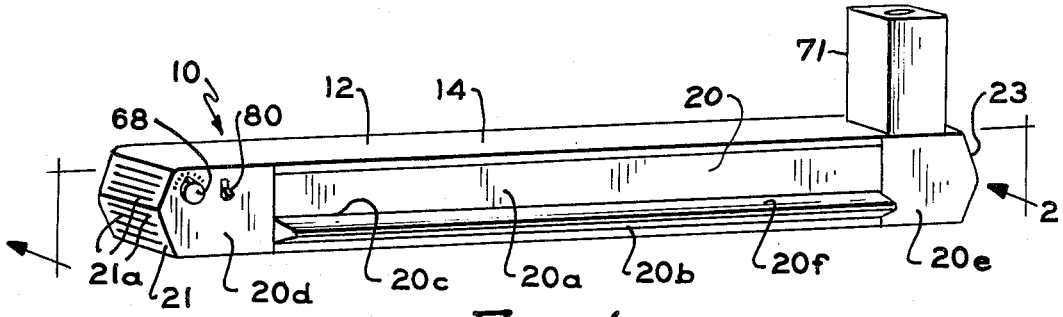
FIG. 1 is a perspective view of an apparatus embodying the invention.

The invention provides a diazo sheet developer that has a development chamber interposed between two pairs of aligned rollers, the first pair to feed sheet material into the development chamber and the second pair to withdraw the sheet such that the sheet passes directly through the apparatus in a straight line and as will be described in more detail below without touching any machine parts which could scratch it. The chamber is composed of upper and lower development tanks each of which preferably comprises a generally channel-shaped metal extrusion that is open on the side thereof facing the sheet as it passes through the machine, i.e. the center of the machine. In the preferred embodiment, the sheet material passes horizontally such that the upper tank opens downwardly while the lower tank is closed along its lower end and opens upwardly at its top facing the film. One or both of the tanks is heated and ammonia is preferably metered at a predetermined rate to produce ammonia vapor within the development tank.

In the preferred form of the invention, a pair of vertical plates are provided adjacent the ends of the tanks, and a gasket is compressed between the plates and the ends of the tanks for reliably sealing the tank ends. Resilient gaskets formed from compressible material are also compressed between the roll ends and the plate for sealing the ends of the rolls.

A preferred roller of a unique design is constructed from a metal roll over which an elastomeric hose is stretched, the exterior of which is ground down to provide an exposed surface of predetermined dimensions concentric with the center of the metal roll inside.

Outside the development chamber is a fume collection plenum communicating with a blower means and a vapor disposal means so that any vapor escaping from the development chamber is collected and disposed of without being able to escape into the atmosphere. The pump used for distributing ammonia is preferably enclosed within the vapor collection plenum as is the entire development chamber. The rollers are each sealed along their length by the provision of an elongated sealing strip engaged on the surface of the roller with some of the strips being engaged at a point normal to the roller on a side opposite the point of engagement between the rollers. In this way, the strips form a dual function. Besides sealing the roller edges against the escape of vapor, they also yieldably bias the rollers toward one another and eliminate the need for springs to provide this function.

With precision ground rollers on opposite sides of the development chamber, a straight-through feed is provided. There are no machine parts in the path of the sheet as it travels from the inlet to the outlet and, accordingly, the sheets will not touch anything that could scratch or otherwise damage them during the development process. In a preferred form of the invention, a timing belt is used for rotating the driven rollers and has been found highly effective in preventing bunching or damage to the film or other sheet material being processed. An automatic pump is provided with a variable displacement rate so that precise amounts of ammonia can be fed to the development chamber. In a preferred form of the invention, electrical resistance heaters are provided along the top and bottom of the development chamber and each is in the form of a rod captivated by a portion of the wall of the development chamber, e.g. by the provision of a groove having a C-shaped cross section extending the length of the top and bottom of the development chamber.

DETAILED DESCRIPTION

Figure 2:
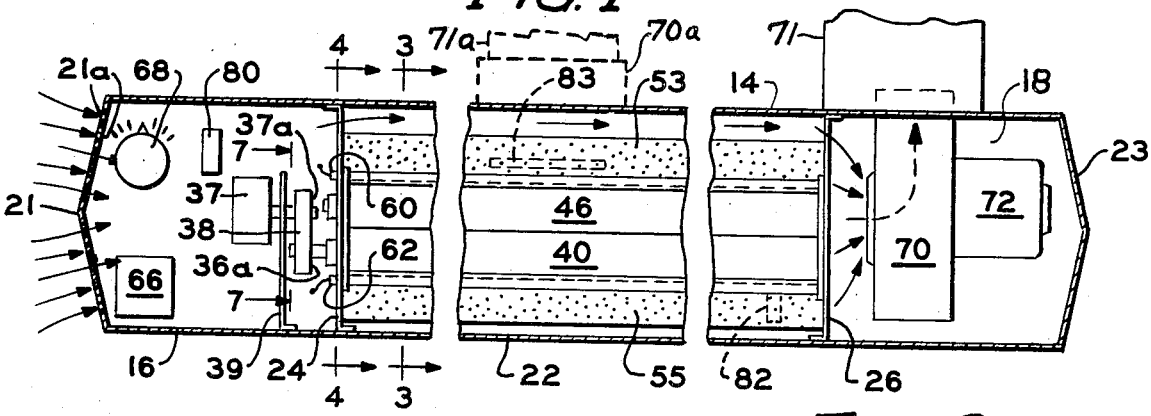
FIG. 2 is a cross-sectional view taken on line 2—2 of FIG. 1.
Figure 3:
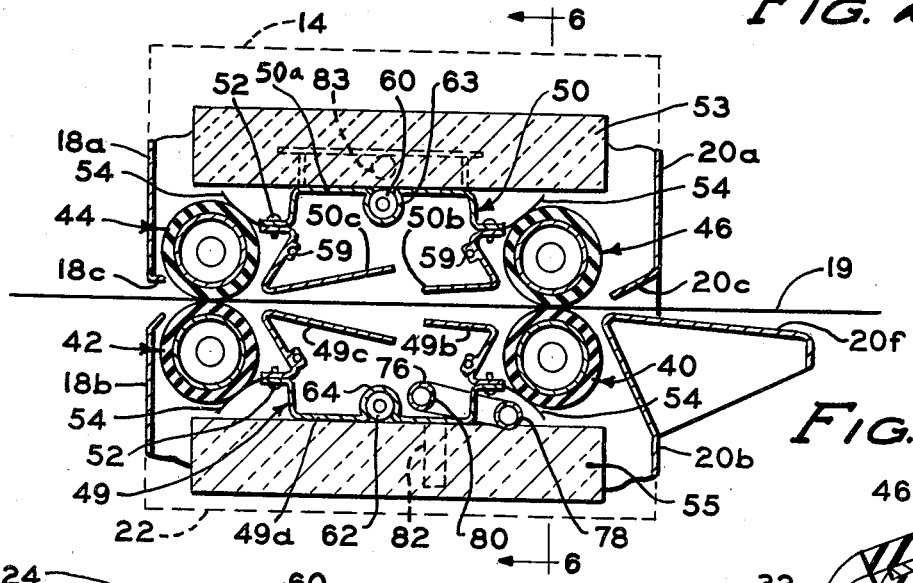
FIG. 3 is a vertical cross-sectional view taken on line 3—3 of FIG. 2.

Referring now to the figures, and particularly FIGS. 1 through 3, the diazo copier is indicated generally by the numeral 10. It includes an exterior housing 12 having a top wall 14, bottom wall 16, rear wall 18, and front wall 20. The rear wall 18 includes an upper wall member 18*a* and a lower wall member 18*b*, between which is an outlet slot or aperture 18*c*. Similarly, the front wall 20 includes an upper wall portion 20*a*, a lower wall portion 20*b* separated by an inlet slot or aperture 20*c*, immediately below which is an entry tray 20*f* for supporting sheet material 19 (FIG. 3) just before it enters the apparatus. At opposite ends of the apparatus are end walls 21 and 23, wall 21 being provided with a multiplicity of parallel air entry louvers or slots 21*a* through which fresh air is drawn into the developer during operation as will be explained fully below.

The lower surface of the housing 12 comprises a flat rectangular base plate 22 to which is rigidly secured a pair of vertically disposed parallel laterally spaced apart side plates 24 and 26. Side plates 24 and 26 are also suitably secured to the top wall 14.

Figure 4:
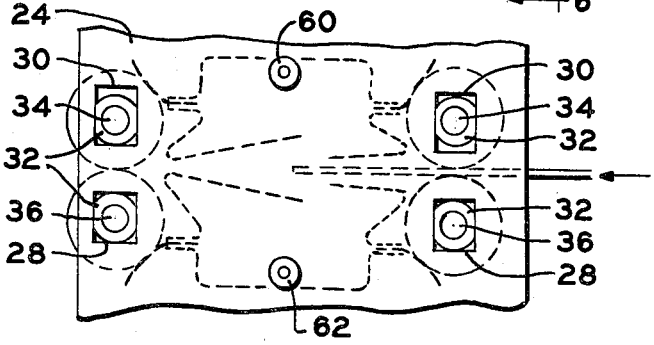
FIG. 4 is a partial vertical cross-sectional view taken on line 4—4 of FIG. 2.
Figure 5:
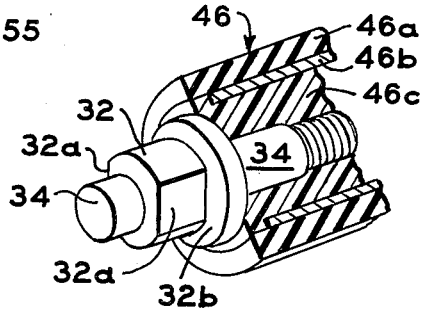
FIG. 5 is a partial perspective view partly in section of the end of one of the rollers and its bushing.

As best seen in FIG. 4, the side plates are provided with square openings 28 above which are located vertically elongated rectangular openings 30, and it is within these openings that the roller support bushings are mounted. The bottom two bushings 32 are fixed, while the upper bushings 32 are able to slide vertically within the vertically elongated openings. The bushings as seen in FIGS. 4 and 5 are provided with flattened diametrically opposed side walls 32*a* that just fit within the openings 28 and 30, respectively, the upper two being free to slide vertically as will be described below. Journal for rotation in the bushings 32 are a pair of idler pins 34 for the upper pair and a pair of drive pins 36 for the lower pair. The rollers that will be described below thus have a pair of aligned pins 34 or 36, as the case may be at each of its ends and each pin is, in turn, journaled for rotation in one of the bushings 32. The bushing can be formed, for example, from a suitable wear resistant low friction plastic resinous material and is preferably provided with a collar 32*b* that rests against the inside surface of one of the side plates 24 or 26.

Figure 7:
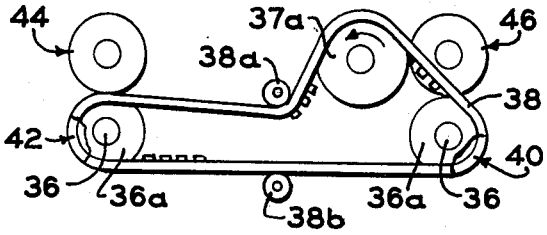
FIG. 7 is a diagrammatic vertical and sectional view taken on line 7—7 of FIG. 2.
Figure 6:
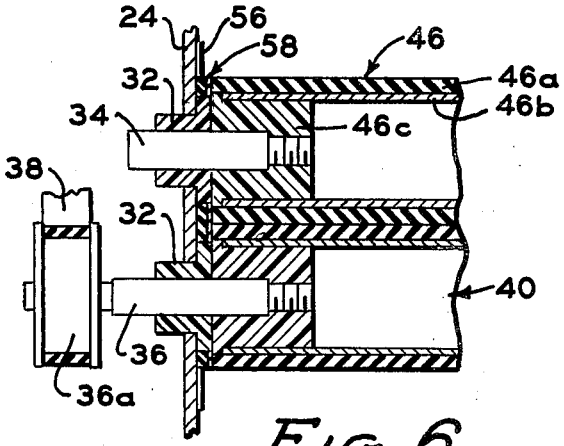
FIG. 6 is a partial vertical sectional view taken on line 6—6 of FIG. 3.
Figure 11:
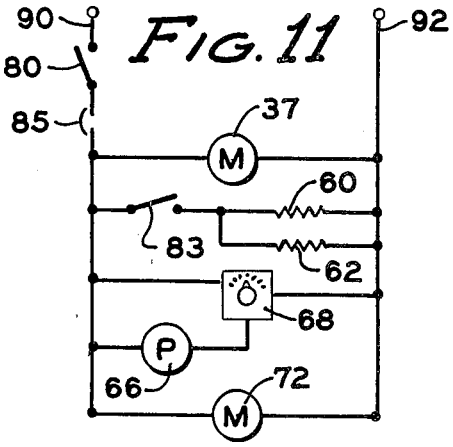
FIG. 11 is a circuit diagram of the apparatus.

As best seen in FIGS. 6 and 7, the drive pins 36 are provided with pulleys 36*a* and 36*b* over which is entrained a timing belt 38. The belt 38 is also entrained over a drive pulley 37*a* that is affixed to the shaft of the drive motor 37 (FIGS. 2 and 11). Belt tension is maintained by idler pulleys 38*a* and 38*b* (FIG. 7).

The lower rollers driven by the drive pins 36 are designated 40 and 42 and each is positioned with its uppermost edge in alignment between the inlet and outlet slots 20*c* and 18*c*, respectively. The upper idler rollers 44 and 46 are mounted immediately above rollers 42 and 40, respectively, to define a first pair of parallel mating inlet rollers 40 and 46 and a second pair of mating outlet or exit rollers 42 and 44. When the motor 37 is actuated during operation, the feed rollers 40 and 46 carry the sheets 19 from right to left in FIG. 3 through the apparatus from the inlet 20*c*, and the exit rollers 42 and 44 carry the sheets out of the apparatus through slot 18*c*. Since the mating surfaces of the roller pairs are in alignment, the apparatus provides a straight-through feed of the sheet material 19 and, as seen in FIG. 3, the sheets don't touch anything between the roller pairs and cannot be scratched or otherwise damaged during development. Motor 37 is supported in any suitable manner, as by means of the supporting plate 39, fastened at its lower end to the base plate 22.

Construction of the rollers, of which roller 46 is an example, will now be described with reference to FIGS. 5 and 6. Each of the rollers is composed of an inner roll member consisting of a metal tube 46*b*, over which is stretched a rubber hose 46*a*. The hose is slid over the tube 46*b* in this way. The tube 46*b* is closed at one end and the hose is started over the end of the tube. Compressed air is then forced into the hose causing it to expand and, as the hose expands, its diameter increases sufficiently so that it will slide easily onto the tube 46*b*. The source of compressed air is then removed and the resiliency of the material from which the hose is made causes it to contract tightly onto the tube 46*b*. Plugs 46*c* are then mounted in each end and the idler pin 34 or drive pin 36 is screw threaded into place in the plug. The roller is then centered on a grinder and a high speed abrasive grinding wheel is used to precision grind the surface of the rubber hose 46*a* to the predetermined diameter required. The dimensions of the rollers will accordingly be very precise and the surface will be concentric with the center of rotation. In addition, the surface has a very high coefficient of friction, enabling the rollers to grip the sheets securely as they rotate. The exterior layer 46*a* can be of any suitable resilient material such as synthetic rubber and particularly a closed cell foam rubber such as Hypalon. The rollers are ground to $\pm 0.010$ inches. The rubber tube is held in place by its own resiliency which, because it is stretched on the aluminum tube 46*b*, causes it to securely grip the outer surface thereof, the resulting friction holding it in place. While the center portion 46*b* of the roller can be formed from a variety of materials, aluminum tubing having a 1/16" wall and a 1" O.D. has been outstanding and results in a very lightweight roller that is yet resistant to deflection at the center which, if it were to occur, might allow vapor to escape from the developing chamber, and this advantage has permitted the use of relatively long rollers such as rollers 42" in length that exhibit a reliable seal along the length of each pair of rollers on the line where they are tangent to one another.

The development chamber in the center of the apparatus as seen in cross-section is composed of upper and lower portions comprising identical lower and upper ammonia tanks 49 and 50, respectively. The tanks 49 and 50 can conveniently be formed from generally channel-shaped aluminum extrusions, tank 49 being closed at the bottom and opening upwardly, while tank 50 at the top is closed at its upper aspect and opens downwardly. Each of the tanks is composed of three separate extrusions, a center or connecting extrusion 49*a*, 50*a*, having lateral flanges at its edges to which are connected generally Z-shaped extrusions 49*b* and 49*c* (tank 49) and 50*b* and 50*c* (tank 50). The Z-shaped extrusions are provided with flanges that mate with the corresponding flanges on the connecting extrusions and are secured to them by fasteners such as machine screws 52. It will be seen that the free ends of extrusions 49*b* and 50*b* define sheet inlet guides for material passing through the apparatus and the free ends of 49*c* and 50*c* define exit guides with the free edges thereof spaced further apart than the edges closest the outlet of the apparatus. This helps to guide paper or film that may be curled at its end toward the outlet 18*c*. In this way, the guide sections 49*b*, 50*b*, and 49*c*, 50*c* can be thought of as inlet guides and exit guides, respectively, for guiding sheet material through the apparatus. It should be noted, however, that once the sheet material reaches the nip between rollers 42 and 44, it will not touch any of the guides or other parts of the apparatus, thereby reducing the likelihood of becoming scratched.

Mounted above and below the tank are upper and lower insulation pads 53 and 55, respectively, which can be composed of fiberglass or other suitable heat insulating material for reducing heat transmission away from the development chamber, which, during operation, is maintained at elevated temperatures as will be described fully below.

Figure 12:
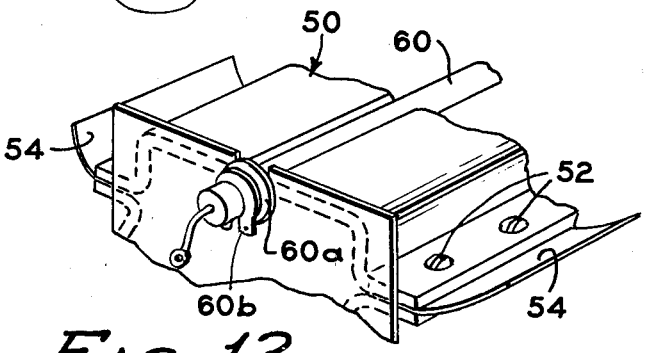
FIG. 12 is a perspective view of the end of the top ammonia tank 50 and its sealing gasket 56.

The sealing means provided between the development chamber and the rollers will now be described by reference to FIGS. 3, 4, and 12. As shown in the figures, elongated ribbon-shaped sealing strips 54 extend between the tanks and the rollers. The strips 54 are secured at their inward edges between the mating extrusion flanges of the tanks 49 and 50 fastened together with screws 52. The free edges of the strips 54 are engaged upon the surface of the rollers with the surface of the rollers being free to slide against the contacting surfaces of the sealing strips. The resiliency or elasticity of the sealing strips holds their surfaces in tight engagement with the surfaces of the rollers thereby providing a reliable seal throughout their length. Suitable sealing strips 54 can be formed from two layers of 0.001" thick stainless steel ribbon. The upper strips 54 yieldably engage the upper surfaces of rollers 44 and 46 at a point substantially opposite their engagement with the lower rollers. In this way, the upper two sealing members yieldably bias the upper two rollers downwardly toward the lower roller thereby providing the dual function of maintaining the contacting roller pairs in engagement and allowing them to spring apart when a large object passes through while, at the same time, serving as a sealing strip for the development chamber to prevent the unwanted escape of ammonia vapor. During operation, as work pieces pass between the rollers, the upper rollers 44 and 46 are free to slide upwardly a short distance against the yieldable biasing effect of the upper strips 54 by virtue of the upward travel of the bushings 32 in their supporting slots 30, as shown with respect to roller 46 in FIG. 4 which, in the figure, is depicted by being displaced upwardly a small distance against the spring action of the sealing strip 54.

The end of each of the tanks 49 and 50 is sealed against the escape of gas by the provision of an elastic gasket 56 of generally rectangular shape sandwiched between each cut end of each tank and the side plates 24 and 26, respectively. The gaskets 56 are under compression, thereby preventing the escape of vapor. The tanks can be held in place in any convenient manner, as by means of screws 59 which extend through the side plates 24 and 26 into suitable screw holes provided in the tanks. The screws 59 are also shown in FIG. 3. Mounted between the side plates 24, 26 and the rollers 40–46 are roller sealing gaskets 58 formed from a suitable resilient flat sheet stock such as rubber. An excellent sealing material comprises synthetic rubber such as EPDM rubber having a layer of a low-friction material such as Teflon bonded to the inward surface thereof contacting the ends of the rollers 40–46 to provide a low friction sealing surface under compression against the ends of the rollers to reliably seal them against the escape of vapor. In this way, the rollers can rotate freely while the vapor seal is maintained by the resiliency of the sealing gaskets 58. The gaskets 58 are provided with openings 58*c* to accommodate the bushings 32.

At the top and bottom of the developing tanks are electrical resistance rod heaters 60 and 62 which are slid from the end during construction into a channel-shaped recesses 63 and 64 formed in the extrusions 50*a* and 49*a*, respectively. The channels 63 and 64 extend around more than 180° of the periphery as seen in section, thereby captivating the heating rods 60 and 62 to reliably hold them in place at all points along their length. Accordingly, the heating rods 60 and 62 cannot move or sag from the desired location and, at the same time, are held in contact with the tanks at all times thereby reliably assuring uniform heat distribution throughout the tanks. In a typical situation, the heaters are sufficiently hot to maintain the interior of the chamber at about 180° F. at the point where the film 19 is located. Each end of each heating rod is maintained in place by a fibrous insulating washer 60*a* and a snap ring 60*b* as shown in FIG. 12.

Figure 10:
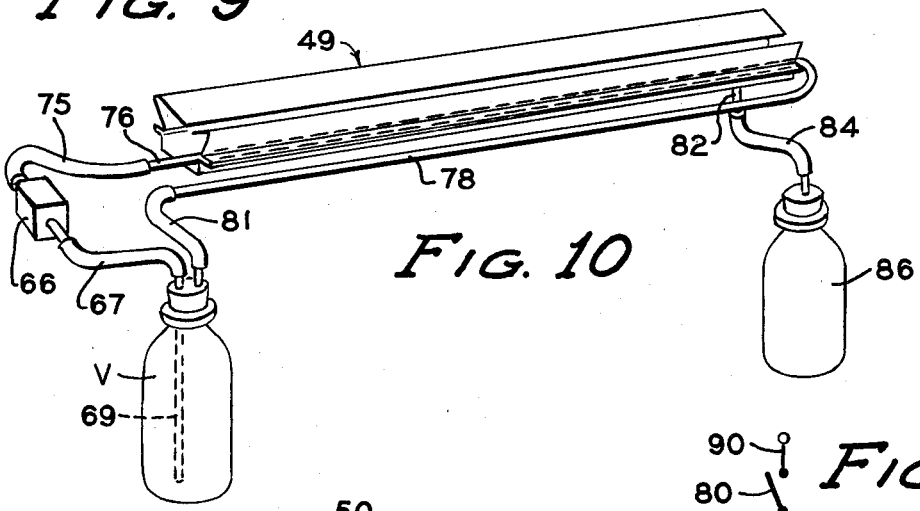
FIG. 10 is a perspective diagram of the ammonia distribution system.

The distribution of ammonia vapor when used will now be described in connection with FIGS. 2, 10, and 11. As seen at the left in FIG. 2, there is provided a positive displacement electrically-operated pump 66 of any suitable known construction connected by means of a hose 67 to an outlet pipe 69 of an ammonia storage vessel V. In this way, the pump 66 withdraws the ammonia forcing it through supply hose 75 to a U-shaped distribution pipe having parallel legs 76 and 78, the former of which is provided with openings 80 of a small diameter along its length. The leg 76 of the distribution pipe extends through the ammonia tank 49, as best seen in FIGS. 3 and 10, and as the pump operates, small quantities of ammonia are expelled through the openings 80 and accumulate at the bottom of the tank 49 temporarily until vaporized by the heater 62. The warm ammonia vapor fills the chamber, thereby developing sheets 19. From leg 78 the excess ammonia is returned via hose 81 to the vessel V. Any excess ammonia is withdrawn from the bottom of the tank 49 through a drain fitting 82 via hose 84 to a collection vessel 86.

One suitable method for controlling the operation of pump 66 is through the use of a timer 68 which has a manual control knob as shown in FIGS. 1 and 2 that can be set to operate the pump intermittently at pre-selected intervals to thereby pump greater or lesser quantities of ammonia to the tank per unit of time.

The electrical circuit is shown in FIG. 11. As seen in the figure, current is supplied through conductors 90 and 92 to an on-off switch 80 in series with a circuit breaker 85. Heaters 60 and 62 are wired parallel with motors 37 and 72, and the timer 68 is wired across lines 90, 92 to supply current to the pump 66 for selected intervals of time. Numeral 83 represents a thermal safety switch and a thermostat, both of which are connected in series with the heaters. The thermostat maintains a set temperature and the thermal safety switch interrupts the current in case the tank temperature becomes excessive.

Figure 9:
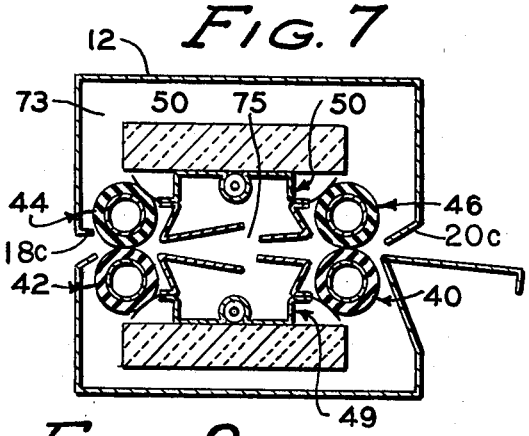
FIG. 9 is a diagram illustrating the relationship between the development chamber and the outer plenum.
Figure 8:
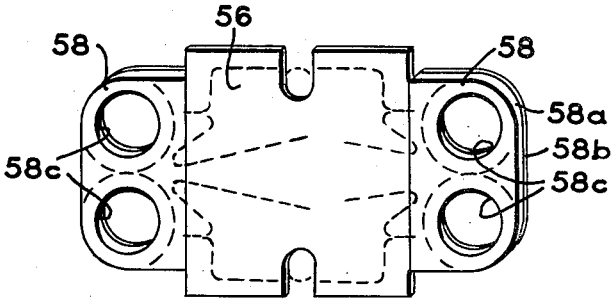
FIG. 8 is a perspective view of the tank and roller sealing gaskets.

Refer now to FIG. 9 which illustrates clearly the inner development chamber 75 composed of the upper and lower development tanks 49 and 50 that with the rollers and their sealing strips defines a closed compartment enclosed within an outer compartment 73 that functions as a fume collection and removal plenum. The outer fume collection and removal plenum has a continuous stream of air passing through it so that any vapor leaking from the chamber 75 will be withdrawn and disposed of. As seen best in FIG. 2, incoming air passes into the outer fume collection and removal plenum 73 through louvers 21*a*. The incoming air then passes over the pump 66 and along all sides of the chamber 75 to a blower 70 which expels the air into any suitable disposal means such as a duct leading to the outside or into a replaceable ammonia neutralizing cartridge 71 available commercially which absorbs ammonia fumes. Thus, by providing an outer vapor collection and removal plenum surrounding the inner developing chamber and by placing the ammonia pump 66 within this plenum, any leaking ammonia from either the chamber 75 or the pump 66 is withdrawn and disposed of without entering the room where the device is used. In an alternative shown in dotted lines of FIG. 2, the blower 70 and cartridge 71 are replaced by cartridge 71*a* and centrally located blower 70*a* which draws air and vapor out of plenum 73 and exhausts it through cartridge 71*a*. In this case walls 24 and 26 seal the entire crossection of the housing 12 so that air and vapor is drawn in solely through slots or apertures 18*c* and 20*c* and louvers 21*a* are eliminated. Blower 70*a* is reversed in thermal development to cool the rollers by forcing air into the plenum 73 and out through slots or apertures 18*c* and 20*c*.

The invention has proved highly effective in operation, and the timing belt, in addition to being quiet in operation, advances the rollers uniformly and smoothly to provide even movement of the film which helps prevent damage to the film and promotes even development. Since there is no carrier or belt and since the film does not touch anything between the inlet and exit rollers, it will not be scratched during operation. Sealing strips 54 can be easily removed and replaced by removing screws 52.

When the apparatus is used for thermal development, i.e. by the action of heat alone, the heaters are turned up to a higher setting so that a temperature of approximately 230° F. exists at the film plane and the chamber surface is about 300°-330° F.

The invention has proved successful operating solely as a thermal diazo developer with the ammonia removed and pump 66 is turned off. This success results from several factors. One of the most important is the application of heat to the sheet material almost entirely by hot air convection. As described above, the development chamber is provided with inlet and outlet slots which divide it into compartments located above and below the plane of the sheet material. One heating rod is in contact with each compartment viz. the channel-shaped aluminum extrusion, thereby heating it; and each compartment in turn heats the air therein such that heat transmission to the sheet material 19 is primarily by hot air convection. The inner and outer surfaces of the aluminum extrusions forming the compartments 49 and 50 are uncoated and are highly polished, accordingly, heat radiation therefrom is at a minimum. While not utterly essential, it is highly preferred that heaters be provided for both the upper and lower compartment for two reasons. First, sheet material can be passed through with the emulsion either up or down and development will take place equally well in both instances. Second, the application of heat from both the top and the bottom shortens the dwell time so that the machine capacity is increased.

Another important factor that contributes to the successful operation of the thermal development mode is the fact that the apparatus is constructed and the compartments are located so that the film passes straight through the apparatus without contacting any stationary parts which could scratch or damage the film. This is particularly important in thermal development since the film is very unstable at high temperatures. As seen in FIG. 3, for example, the film will not rub on anything when passing through the apparatus. It is important to use good engineering practice in selecting materials that will not be damaged by high heat and to provide sufficient room for thermal expansion of parts as they become hot as well as to allow for slippage between any parts that have a different coefficient of expansion or are heated to different temperatures. For example, to allow for expansion it is desirable to enable each sealing strip 54 to be free to slide longitudinally between the adjacent flanges of tanks 49 and 50 where it is supported along its edge. This can also be accomplished by tightening screws 52 only after the apparatus has come up to operating temperature.

It is apparent that many modifications and variations of this invention as set forth may be made without departing from the spirit and scope thereof. The specific embodiments described above are given by way of example only, and the invention is limited only by the terms of the appended claims.

What is claimed is:

1. A diazo sheet material developer comprising an inner ammonia developing chamber, means for supplying ammonia vapor thereto for developing said diazo sheet material as it passes through the developing chamber, said developer having sheet material inlet and outlet apertures, sheet feeding means for passing said diazo sheet material through said apparatus, and said developer having an outer vapor collection and disposal plenum surrounding and enclosing the developing chamber for collecting and removing ammonia vapor, said collection plenum having openings therein to admit outside air and an air blower means communicating with said outer plenum for drawing air from the outside atmosphere in through said openings and for expelling the air and any vapor therein to a vapor disposal means, whereby ammonia vapor that escapes from the ammonia developing chamber enters the collection plenum and is withdrawn therefrom and passed to the vapor collection means, the ammonia is supplied to the developing chamber by a pump and the pump is enclosed within the plenum.

2. The apparatus of claim 1 wherein the blower is provided at one end of the plenum, the developing chamber is in the center thereof, and the pump is at the opposite end whereby air is passed over the pump, thence over the developing chamber and thereupon enters the blower after traveling the length of the apparatus.

3. A diazo sheet material developer comprising an inner ammonia developing chamber, means for supplying ammonia vapor thereto for developing said diazo sheet material as it passes through the developing chamber, said developer having sheet material inlet and outlet apertures, sheet feeding means for passing said diazo sheet material through said apparatus, and said developer having an outer vapor collection and disposal plenum surrounding and enclosing the developing chamber for collecting and removing ammonia vapor, said collection plenum having openings therein to admit outside air and an air blower means communicating with said outer plenum for drawing air from the outside atmosphere in through said openings and for expelling the air and any vapor therein to a vapor disposal means, whereby ammonia vapor that escapes from the ammonia developing chamber enters the collection plenum and is withdrawn therefrom and passed to the vapor collection means, said sheet feeding means comprises a first pair of mating inlet rollers and a second pair of mating outlet rollers adjacent the inlet and outlet apertures, respectively, for passing sheet materials through the developing chamber, elongated ribbon-shaped sealing strips extending the length of said developing chamber and contacting the surfaces of the rollers to seal the developing chamber throughout its length, and the entire length of each seal between each said strip and its contacting roller is enclosed within the vapor collection and disposal plenum, whereby vapor leaking from said seals into the plenum throughout the length of each seal is collected and removed through the plenum.

4. A diazo sheet developer comprising a housing having a base plate, spaced parallel side plates extending vertically from said base plate and being mounted thereupon, a tank sealing gasket in sheet form adjacent the inner surface of each side plate, upper and lower aligned horizontally disposed channel-shaped development tanks mounted one above the other, said tanks comprising enclosing walls extending longitudinally and terminating and a pair of free ends, said free ends being sealed by said gaskets, and means forcing the side plates toward the tanks for compressing the gaskets therebetween to seal the ends of the tanks, and pairs of drive rollers adjacent the tanks for advancing sheet material through said apparatus and resilient sheets of gasket material compressed between the ends of said rollers and the side plates adjacent thereto.

5. The apparatus of claim 4 wherein the gaskets between the rolls and the side plates have a low-friction surface in contact with the roll ends.

6. The diazo sheet developer of claim 4 wherein the upper development tank comprises an elongated extrusion having a closed upward end and a downwardly opening lower end with guides for directing sheet material through said apparatus below the lower end thereof and a lower tank comprises an extrusion having a closed lower end, upwardly extending wall members and an open upward end having guide members for directing sheet material through said apparatus.

7. The apparatus for claim 6 wherein guides in the upper tank are spaced above the plane occupied by said sheet material passing through the apparatus and the guides of the lower tank are positioned beneath said plane whereby sheet material traveling through the apparatus normally does not contact fixed machine elements when passing therethrough.

8. The apparatus of claim 4 wherein elongated electrical resistance heaters are engaged with at least one of the tanks and extend longitudinally thereof, said tank includes a groove therein at least partially enclosing the heater, whereby uniform heat transfer from the heater to the tank is maintained at all times.

9. The developer of claim 8 wherein said groove enclosing the heater extends around the heater a distance of more than 180° F., as seen in cross-section, thereby captivating the heater within the groove to prevent undesired movement of the heater away from the tank.

10. A diazo sheet developer comprising an ammonia chamber for developing said sheet material, said chamber having an inlet and an outlet slot, a pair of contacting inlet rollers adjacent the inlet slot on one side of the apparatus and a pair of contacting outlet rollers adjacent the outlet slot on the opposite side of the chamber, drive means for rotating at least some of the rollers, dual purpose sealing members formed from elastic strips of sheet material extending longitudinally of the rollers and slideably engaged against the surface of the rollers to seal the developing chamber and at least some of the sealing strips engaging the rollers at points opposite the contact area between the rollers for yieldably biasing the rollers together as well as for sealing the developing chamber, each pair of rollers comprises a first roller having a drive means connected thereto and a second roller mounted for sliding movement along an axis toward and away from the driven roller and some of the strips yieldably biasing the second roller into contact with the driven roller, said rollers of each pair being held in contact solely by the resiliency of the elastic sealing strips.

11. A diazo sheet developing apparatus, said apparatus comprising a central sheet developing chamber adapted to be filled during operation with ammonia, a framework means, said apparatus having an inlet and an outlet, a pair of mating inlet rollers and a pair of mating outlet rollers, drive means connected to rotate at least some of the rollers, vertically disposed side plates affixed to the framework at the ends of the rollers, and stationary resilient sealing means formed from resilient sheet stock compressed between the side plates and the ends of the rollers to seal the roller ends and a layer of low-friction plastic resinous material between the rollers and the sheet means, whereby said rollers can rotate freely while the seal is maintained under compression at all times by the resiliency of the sealing sheet means.

12. A diazo developer suitable for developing diazo sheet material by the action of heat alone and comprising a development chamber, said chamber having sheet material inlet and outlet slots dividing said chamber into first and second compartments on opposite sides of a plane extending between said slots and normally occupied during operation by said diazo sheet material passing through said apparatus, a heater in at least one of said compartments for heating said compartment, said heater being in contact with the compartment to heat it and said compartment in turn heating the air therein such that heat transmission to said sheet material is primarily by hot air convection, said apparatus being constructed such that the compartments are located in positions wherein no parts of said apparatus will touch the film passing through the apparatus whereby the film will pass directly from the inlet to the outlet without contacting any parts of the apparatus, first and second pairs of sheet advancing rolls adjacent to the inlet and outlet slots for supporting and carrying the sheet material through said apparatus and drive means for at least one of the rolls to impart rotation thereto to advance the sheet material whereby said apparatus will develop the sheet material solely by the application of heat, each of said pairs of rolls are positioned outside of the development chamber adjacent to the sheet material inlet and outlet slots and each pair comprises an idler roll and a driven roll with the surfaces of each pair running in contact with one another along a line and said line of contact defining a plane for the path of movement of the sheet material straight through said apparatus and the sheet material is supported solely by the rolls.

13. The apparatus of claim 12 wherein an air plenum surrounds the development chamber, air blower means communicates with the plenum for forcing air into the plenum and exhausting the air through the inlet and outlet slots to cool the first and second pairs of rolls.

14. A dual purpose vapor and thermal developer for diazo sheets comprising a heated development chamber, a housing around the chamber having inlet and outlet slots therein on opposite sides of the chamber, a mating pair of inlet rollers and a mating pair of outlet rollers in said housing adjacent said slots and reversible blower means for forcing air from the housing into an air disposal means and being adapted to operate in reverse for forcing air into the housing and out through the slots to cool the rollers during thermal development.

* * * * *